United States Patent [19]
Baker
[11] 4,316,415
[45] Feb. 23, 1982

[54] DETONATING CORD WITH FLASH-SUPPRESSING COATING

[75] Inventor: James J. Baker, Benson, Ariz.

[73] Assignee: Apache Powder Company, Benson, Ariz.

[21] Appl. No.: 24,353

[22] Filed: Mar. 27, 1979

[51] Int. Cl.[3] ..... C06C 5/04
[52] U.S. Cl. ..... 102/275.8
[58] Field of Search ..... 102/27 R, 275.8; 149/11, 93

[56] References Cited

U.S. PATENT DOCUMENTS

| | | | |
|---|---|---|---|
| 2,216,835 | 10/1940 | Carothers | 102/27 R |
| 3,507,719 | 4/1970 | Hodgson | 149/11 |
| 3,544,360 | 12/1970 | Gardner | 149/11 X |
| 3,740,278 | 6/1973 | Sakreis et al. | 149/11 |
| 4,102,428 | 7/1978 | Kelly et al. | 102/27 R X |
| 4,177,732 | 12/1979 | Steele | 102/27 R X |
| 4,178,853 | 12/1979 | Garrison et al. | 102/27 R |

OTHER PUBLICATIONS

Condensed Chemical Dictionary, Van Nostrand Reinhold Co., Eighth Edition, p. 71.

*Primary Examiner*—Peter A. Nelson
*Attorney, Agent, or Firm*—Townsend and Townsend

[57] ABSTRACT

The disclosed invention is an effective detonating cord which does not ignite combustible materials adjacent and exterior to the cord upon detonation. The cord in one of its broadest aspects comprises a core of high explosive coated with a composition extrudable around the core at safe temperatures and comprising a halogenated linear polymer with sufficient halogenation to prevent ignition of combustible materials adjacent and exterior to the cord upon detonation. The core preferably contains pentaerythritol tetranitrate and the preferred polymer is substantially amorphous chlorinated polyethylene (CPE) having about 25 to 50 weight percent chlorine. The coating composition frequently also includes synergistic agents known in the flame retardant arts such as antimony trioxide which enhance the flash-suppressing qualities of the coating, plasticizers such as polyethylene polymers and other materials such as extrusion aids. The coating composition can easily be extruded around the PETN core at safe temperatures to provide a thin but effective flash-suppressing coating for the cord. The resulting cord can effectively be detonated and is flexible so that the cords can be tied together to form a branched cord so as to initiate several high explosive charges at once.

25 Claims, No Drawings

DETONATING CORD WITH FLASH-SUPPRESSING COATING

BACKGROUND OF THE INVENTION

1. Field of the Invention

This invention relates to detonating cords with flash-suppressing coatings which prevent the detonated cord from igniting adjacent materials.

Detonating cord is an item of commerce consisting of a core of highly explosive material, usually particulate pentaerythritol tetranitrate (PETN), encased in various yarns and/or plastics. The cord is used to transmit a detonation front from one location to another, usually for the purpose of initiating one or several charges of high explosives. It functions by detonating when initiated by a blasting cap, the detonation being an intense chemical reaction of very short duration which liberates large amounts of heat and gases manifested in the form of a visible flash.

In use, such detonating cord is usually laid across the ground with subsidiary lines attached to main branch lines to initiate several charges of high explosives essentially at once. In some applications, the cord is laid over and through dry vegetation, for example when it is used in seismographic prospecting or in clearing fields. This has presented a particular problem, however, because the highly exothermic explosion of the PETN cord can easily, and has, initiated grass and forest fires.

The primary object of this invention is to provide a detonating cord with a coating which will inherently suppress the flash and thereby prevent the ignition of natural solid fuels with which the cord is in contact, without detrimentally affecting the velocity or energy of initiation of detonation and the ability of the cord to initiate the detonation of a high explosive charge.

2. Summary of the Prior Art

Most currently produced detonating cord consists of a PETN core encased in a polyethylene coating which prevents migration of water into the core which can render the core non-explosive. This coating, however, is generally inadequate to suppress the detonation flash and thereby prevent ignition of adjacent materials.

Some cords have been developed in an attempt to solve this problem. One such cord which has been used for clearing fire breaks in fighting forest fires comprises a PETN core, usually having 200 to 400 grains PETN per foot, encased in a layer of particulate chloride or phosphate salt sometimes including water of hydration. The salts are thought to absorb energy of the detonation, lower the detonation temperature and reduce the likelihood of igniting adjacent materials.

However, these detonating cords have several disadvantages. Special machinery is required to produce the cord, and the cord must be carefully checked over its entire length to insure that the salt is in place, a task complicated by the covering used to hold the salt in place. Furthermore, the amount of salt required exceeds the amount of explosive in the cord, so that the resulting bulk of the cord renders it difficult to tie the cords together to provide branched cords which transmit the detonating front to explosives in several locations.

Additionally, a detonating cord was developed but largely abandoned which utilized polyvinyl chloride (PVC), a flame retardant, as an attempted flash-suppressing coating. However, the use of PVC as a coating produced several problems. Aside from the fact that the PVC may have released vinyl chloride monomers which are though to be cancer causing agents, PVC itself could not be extrusion-coated on the PETN core to produce thin coatings at safe temperatures below about 320° F. Coating compositions containing PVC diluted with plasticizers so as to be extrudable at safe temperatures were ineffective as flash-suppressants. Furthermore, the plasticizers tended to migrate into the PETN cord and reduce the detonation velocity of the cord at least in half, resulting in a cord with less than desirable initiating power.

SUMMARY OF THE INVENTION

It has been found that the cord of the present invention is an effective detonating cord which does not ignite adjacent fuels upon detonation and avoids many of the problems associated with such prior cords. The cord in one of its broadest aspects comprises a core of high explosive coated with a composition extrudable around the core at safe temperatures and comprising a halogenated linear polymer having sufficient halogenation to prevent ignition of combustible materials exterior and adjacent to the cord upon detonation. The preferred polymer is substantially amorphous chlorinated polyethylene (CPE) having about 25 to 50 weight percent chlorine. The coating composition frequently also includes synergistic agents known in the flame retardant arts such as antimony trioxide which enhance the flash-suppressing qualities of the coating, plasticizers such as polyethylene polymers and other materials such as extrusion aids. The coating composition can easily and safely be extruded on the PETN core to provide a thin but effective flash-suppressing coating for the cord. The resulting cord can easily be detonated and is flexible so that two cords can easily be tied together to form branched lines so as to initiate several high explosive charges at once.

DESCRIPTION OF THE SPECIFIC EMBODIMENTS

The present invention is a detonating cord which comprises a core of high explosive coated with a composition extrudable around the core at safe temperatures and comprising a halogenated linear polymer with sufficient halogenation to prevent ignition of combustible materials exterior and adjacent to the cord upon detonation.

The core usually consists of PETN, preferably at a loading of about 20 to 50 grains per foot. Safe temperatures for extrusion around the core are generally considered to be temperatures not greatly in excess of the melting point of the high explosive core. Upon extrusion at higher temperations, the core itself may explode. In the case of PETN, the melting point is about 290° F. and extrusion can generally be safely carried when the coating temperature in the extruder is about 320° F. or lower. In the case of RDX, another possible core material, safe temperatures in the extruder are generally about 360° F. or lower, the melting point of RDX being about 337° to 339° F.

Although various halogenated linear polymers can be used, the preferred polymer is substantially amorphous CPE having about 25 to 50 weight percent chlorine, a flame retardant. The CPE is of the formula:

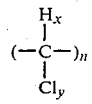

wherein x and y are numbers from zero to two. In manufacture, the chlorine atoms are usually substituted for hydrogen atoms on the base polyethylene chain. The crystalline forms of CPE are less desirable than the substantially amorphous forms because they cannot easily be extruded onto the core to provide an adequate coating.

Although CPE having higher amounts of chlorine (up to full substitution which amounts to more than about 85 weight percent chlorine) can be used, very high amounts of chlorine are less desirable; material having above 50% by weight chlorine tends to be too hard. The use of halogenated materials having a degree of halogen substitution of or equivalent to less than about 25% by weight chlorine may result in inadequate flash suppressing characteristics, particularly if the polymer constitutes less than about 65% by weight of the composition. Furthermore CPE having less than about 25% by weight chlorine may have too soft a consistency. The use of CPE having about 25 to 50 weight percent chlorine results in a coating which is both easily extrudable and flash suppressing. It is believed that the CPE releases HCl which reacts with hydrogen and hydroxyl free radicals in order to prevent ignition of adjacent materials.

Linear polymers substituted with other halogens such as a mixture of bromine and chlorine can also be used. However, polymers containing bromine for example will usually have no more than about 15 weight percent bromine as polymers with higher levels of bromine tend to be unstable at extrusion temperatures of about 300° F.

Generally the coating composition will contain about 40 to 100% by weight CPE but can be varied according to the halogen content of the polymer and other factors. Preferably, the composition contains 75% by weight or more CPE which has about 25 to 50 weight percent chlorine.

Synergistic agents known in the flame retardant arts such as antimony trioxide, other antimony compounds and zinc borohydrate are preferably used in conjunction with the halogenated linear polymer to aid in inhibiting the combustion process. The synergistic agents are thought to react with materials such as HCl generated from the halogenated polymer to aid in preventing combustion. The preferred synergistic agent is antimony trioxide ($SbO_3$). It is believed to react with HCl generated from the CPE to form antimony chloride ($SbCl_3$) and antimony oxychloride ($SbOCl_3$), both of which are gases at the temperatures involved. These gases react with both hydrogen free radicals and hydroxyl free radicals to aid in inhibiting the combustion process. Preferably the synergistic agent is present in amounts less than about 25 weight percent of the composition.

Other materials can also be blended with the halogenated polymer in the composition to modify or enhance the properties of the composition. Such materials as stabilizers, plasticizers, extrusion aids, and coloring agents can be added with obvious benefits. Up to about 60%, but preferably no more than about 25% by weight or less of the composition can consist of materials other than the polymer. Stabilizers known in the art, such as various phosphorus, lead, and barium compounds (i.e. barium sodium organophosphate) can be used to increase the shelf life of the cord by stabilizing the polymer coating from UV or other environmental exposure. Plasticizers can be added to vary the flexibility of the coating or promote the extrusion process; the preferred plasticizers are epoxidized soybean oil and low density polyethylene, the latter being inherently compatible with CPE and a solid which will not migrate into the PETN core. Extrusion aids such as stearic acid which are known in the art to promote the extrusion process can also be added. Fluorescent organic pigments, other luminescent materials, or non-luminescent coloring materials can be further added to color the cord.

The composition can be prepared by mixing the ingredients to form pellets by procedures known in the art; it is then coated on the PETN core, preferably by extrusion techniques known in the art at safe temperatures below about 320° F. to produce a flexible detonating cord with a thin but effective flash-suppressing coating.

The following examples are offered by way of illustration and not by way of limitation. The term percent (%) as used in the following examples refers to percent by weight.

EXAMPLE 1

The following components were mixed together to produce four different compositions as shown.

| | #1 | #2 | #3 | #4 |
|---|---|---|---|---|
| CPE, 36% chlorine by weight (Dow Number 2243.45) | 87.2% | — | 85.0% | — |
| CPE, 42% chlorine by weight (Dow Number 2243.46) | — | 87.2 | — | 85.0% |
| Low Density Polyethylene | 8.7 | 8.7 | 8.5 | 8.5 |
| Ferro 541A (barium sodium organophosphate) | 1.75 | 1.75 | 1.7 | 1.7 |
| Drapex 6.8 (epoxidized soybean oil) | 1.75 | 1.75 | 1.7 | 1.7 |
| Stearic acid | 0.6 | 0.6 | 0.6 | 0.6 |
| $Sb_2O_3$ | — | — | 2.5 | 2.5 |

Tubings having an inside diameter of slightly less than 0.25 inch were then formed by extrusion of each of the compositions.

Detonating cord having a core of 50 grains PETN per foot was inserted into each of these tubings. Each of the four encased detonating cords was then placed on a pile of sawdust soaked in gasoline and detonated. Although a fire resulted when composition number two was detonated, probably due to poor or uneven extrusion of the composition, no fires resulted when the other tubings were tested. In addition, composition number 1 tended to be rather stiff while composition number 4 was soft; composition number 3 had the most desirable characteristics.

EXAMPLE 2

A batch of composition #3 of Example 1, in the form of pellets, was extruded by a Royle 2 inch extruder onto an uncoated detonating cord containing a core of 30 grains of PETN per foot. The temperature of the molten plastic in the extruder was below 290° F. The detonating cord was coated at the rate of approximately 400 feet per minute, to produce a continuous coating about 0.016 to 0.018 inches thick.

EXAMPLE 3

Another batch of composition #3 of Example 1 was mixed with a Day-Glo fluorescent organic pigment so that the pigment comprised about one-half percent of the composition. This mixture was then extruded by a Royle 2 inch extruder onto uncoated 30 grain detonating cord at the rate of 380 feet per minute. A uniformly coated, uniformly colored detonating cord was produced having a coating thickness of 0.020±0.001 inch.

EXAMPLE 4

A portion of the detonating cord from Example 2 was suspended about 8 to 10 inches over an uncovered pool of gasoline. The pool consisted of approximately one-third of a gallon of gasoline, the depth of the pool being about one to two inches and the diameter approximately nine inches. Ambient temperature was between about 75°-85° F. When the cord was detonated, no fire resulted.

EXAMPLE 5

The test described in Example 4 was repeated using 30 grain detonating cord extrusion-coated with polyethylene. A roaring gasoline fire resulted.

EXAMPLE 6

The colored CPE coated detonating cord of Example 3 was tested in the same manner as described in Example 4. No fires were produced in ten trials.

EXAMPLE 7

Pads of fibrous bone-dry cotton were laid out on the ground and the cords of Example 1 encased in composition #3 and of Example 2 were placed through the pads. No fires resulted when either cord was detonated.

EXAMPLE 8

A polyethylene-coated detonating cord was passed through a pad of cotton as described in Example 7. When this cord was detonated, the pad burst into flames.

EXAMPLE 9

Detonating cord containing a 20 grain/foot PETN core was prepared as described in Example 3.

EXAMPLE 10

A cotton test as described in Example 7 was run with the detonating cord of Example 9. No fire resulted.

EXAMPLE 11

Detonating cord containing a 40 grain/foot PETN core was prepared as described in Example 3.

EXAMPLE 12

A gasoline test as described in Example 4 was run with the cord of Example 11. No fire resulted.

EXAMPLE 13

To determine whether the detonating cord of the present invention could be tied together to effectively initiate several explosive charges essentially at once, two pieces of the detonating cord of Example 3 were tied together using a clove hitch knot with an extra wrap, the end of the first piece being tied around the center of the second piece. The two pieces of detonating cord were then laid out on the ground at right angles to each other. When detonation of the second piece of cord was initiated with a blasting cap, both pieces of the detonating cord detonated. The detonation initiated the explosion of cap-sensitive commercial water gel, an explosive charge, in contact with the ends of the cords.

Thus it can be seen that the cord of the present invention can be effectively used as a detonating cord yet will not ignite nearby flammable materials upon detonation. The coating itself is an extremely effective flash-suppressant for the PETN core and can be easily extruded onto the PETN core at safe temperatures to provide thin but effective coatings. Furthermore, the components of the composition tend not to migrate into the core and reduce the detonation velocity.

Variations in the cord and coating will be obvious to one schooled in the art, and the above examples and description are not to be taken by way of limitation, the invention being described by the appended claims.

What is claimed is:

1. A detonating cord comprising a core of high explosive encased in a composition extrudable at safe temperatures and comprising a halogenated polymer with sufficient halogenation to prevent ignition of combustible materials adjacent and exterior to the cord upon detonation.

2. A detonating cord according to claim 1 and wherein the core consists of pentaerythritol tetranitrate.

3. A detonating cord according to claim 2 and wherein the pentaerythritol tetranitrate is present at a loading of about 20 to 50 grains per foot.

4. A detonating cord according to claim 3 and wherein the composition comprises about 40 weight percent or more of a halogenated linear polymer having a degree of halogen substitution of or equivalent to about 25 weight percent or more chlorine.

5. A detonating cord according to claim 4 and wherein the halogenated polymer is substantially amorphous chlorinated polyethylene having about 25 to 50 weight percent chlorine.

6. A detonating cord according to claim 5 and wherein the chlorinated polyethylene comprises about 75 to 100 weight percent of the composition.

7. A detonating cord according to claim 1 and wherein the composition further comprises one or more synergistic agents.

8. A detonating cord according to claim 7 and wherein the composition comprises one synergistic agent which is antimony trioxide.

9. A detonating cord comprising:

a core containing about 20 to 50 grains per foot pentaerythritol tetranitrate; and a coating of a composition comprising about 75 to 100 weight percent substantially amorphous chlorinated polyethylene having about 25 to 50 weight percent chlorine so that combustible materials adjacent and exterior to the cord are not ignited upon detonation.

10. A detonating cord according to claim 9 and wherein the composition further comprises one or more synergistic agents.

11. A cord according to claim 10 and wherein the composition includes one synergistic agent which is antimony trioxide.

12. A method of making a detonating cord comprising providing a high explosive core;

providing a composition extrudable at safe temperatures and comprising a halogenated polymer having sufficient halogenation to prevent ignition of combustible materials adjacent and exterior to the cord upon detonation; and encasing said core with said composition.

13. A method according to claim 12 and wherein said composition is extruded around said core.

14. A method according to claim 12 and wherein said core comprises pentaerythritol tetranitrate.

15. A method according to claim 14 and wherein the pentaerythritol tetranitrate is present at a loading of about 20 to 50 grains per foot.

16. A method according to claim 15 and wherein the composition comprises about 40 percent by weight or more of said polymer and said polymer has a degree of halogen substitution of or equivalent to about 25 weight percent or more chlorine.

17. A method according to claim 16 and wherein said polymer is substantially amorphous chlorinated polyethylene having about 25 to 50 weight percent chlorine.

18. A method according to claim 17 and wherein said chlorinated polyethylene comprises about 75 to 100 weight percent of said composition.

19. A method according to claim 12 and wherein said composition further comprises one or more synergistic agents.

20. A method according to claim 19 and wherein said composition comprises one synergistic agent which is antimony trioxide.

21. A method of making a detonating cord comprising providing a core of about 20 to 50 grains per foot pentaerythritol tetranitrate;

providing a composition extrudable at temperatures below about 320° F. comprising about 75 to 100 weight percent substantially amorphous chlorinated polyethylene having about 20 to 50 weight percent chlorine; and extruding said composition around said core.

22. A method according to claim 21 and wherein said composition further comprises a synergistic agent.

23. A method according to claim 22 and wherein said synergistic agent is antimony trioxide.

24. A detonating cord according to claim 9 and wherein said composition comprises about 84–88 percent of said chlorinated polyethylene, said chlorinated polyethylene having about 8–9 weight percent low density polyethylene, and about 2–3 weight percent antimony trioxide.

25. A detonating cord consisting essentially of a high explosive component encased in a composition extrudable at safe temperatures, said extrudable composition comprising a halogenated polymer with sufficient halogenation to alone prevent ignition of combustible materials adjacent and exterior to the cord upon detonation.

* * * * *